US009972466B2

(12) United States Patent
Ryu

(10) Patent No.: US 9,972,466 B2
(45) Date of Patent: May 15, 2018

(54) VACUUM INTERRUPTER FOR A VACUUM CIRCUIT BREAKER

(71) Applicant: LSIS CO., LTD., Anyang-si, Gyeonggi-do (KR)

(72) Inventor: Jaeseop Ryu, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days. days.

(21) Appl. No.: 15/412,003

(22) Filed: Jan. 21, 2017

(65) Prior Publication Data

US 2017/0287659 A1 Oct. 5, 2017

(30) Foreign Application Priority Data

Apr. 5, 2016 (KR) ..... 10-2016-0041866

(51) Int. Cl.
*H01H 33/662* (2006.01)
*H01H 33/664* (2006.01)

(52) U.S. Cl.
CPC ..... *H01H 33/662* (2013.01); *H01H 33/664* (2013.01); *H01H 2033/66276* (2013.01); *H01H 2033/66284* (2013.01)

(58) Field of Classification Search
CPC ..... H01H 33/662; H01H 33/664; H01H 33/66261; H01H 2033/66276; H01H 2033/66292; H01H 2033/66269; H01H 2033/66284
USPC ..... 218/139, 134, 136, 147, 155, 118
See application file for complete search history.

(56) References Cited

U.S. PATENT DOCUMENTS 3,231,704 A * 1/1966 Jacobs ..... H01H 33/66207 218/136
3,792,214 A * 2/1974 Voshall ..... H01H 33/66261 218/136
3,913,047 A * 10/1975 Arthur ..... H01H 85/047 337/17
4,039,792 A * 8/1977 Crouch ..... H01H 33/66207 218/128
4,081,640 A * 3/1978 Rich ..... H01H 33/664 218/123
4,983,793 A * 1/1991 Stegmuller ..... H01H 33/66207 218/139

(Continued)

FOREIGN PATENT DOCUMENTS

DE 9317827 5/1995
DE 19753031 4/1999

(Continued)

OTHER PUBLICATIONS

Korean Intellectual Property Office Application No. 10-2016-0041866, Search report dated Apr. 22, 2016, 3 pages.

(Continued)

*Primary Examiner* — Renee Luebke
*Assistant Examiner* — William Bolton
(74) *Attorney, Agent, or Firm* — K&L Gates LLP

(57) ABSTRACT

A vacuum interrupter for a vacuum circuit breaker is disclosed, in which a center shield is arranged between an upper insulating envelope and a lower insulating envelope, whereby the center shield is not provided inside each of the insulating envelopes and thus outer diameters of the respective insulating envelopes are reduced.

7 Claims, 4 Drawing Sheets

(56) References Cited

U.S. PATENT DOCUMENTS

| | | | | |
|---|---|---|---|---|
| 6,891,122 | B2 * | 5/2005 | Renz | H01H 33/66261 218/136 |
| 2003/0141282 | A1 | 7/2003 | Renz | |
| 2013/0062316 | A1 | 3/2013 | Renz et al. | |

FOREIGN PATENT DOCUMENTS

| | | |
|---|---|---|
| EP | 1742242 | 1/2007 |
| JP | 2741925 | 4/1998 |
| JP | 2004235121 | 8/2004 |
| JP | 2004253256 | 9/2004 |
| JP | 2012216325 | 11/2012 |
| JP | 2013517607 | 5/2013 |
| KR | 100379570 | 4/2003 |
| KR | 20130078711 | 7/2013 |

OTHER PUBLICATIONS

European Patent Office Application Serial No. 16207568.3, Search Report dated Jul. 12, 2017, 8 pages.

* cited by examiner

VACUUM INTERRUPTER FOR A VACUUM CIRCUIT BREAKER

CROSS-REFERENCE TO RELATED APPLICATION

Pursuant to 35 U.S.C. § 119(a), this application claims the benefit of earlier filing date and right of priority to Korean Application No. 10-2016-0041866, filed on Apr. 5, 2016, the contents of which are all hereby incorporated by reference herein in its entirety.

BACKGROUND OF THE INVENTION

1. Field of the Invention

The present invention relates to a vacuum interrupter for a vacuum circuit breaker, and more particularly, to a vacuum interrupter for a vacuum circuit breaker, in which a center shield provided in the vacuum interrupter is arranged on the same line as an insulating envelope to reduce a full size of the insulating envelope and save the manufacturing cost.

2. Description of the Conventional Art

Generally, a circuit breaker and a switch are devices for directly controlling power supply to load by opening or closing an electric circuit in a power system. As examples of the circuit breaker and the switch, a circuit breaker having a capability of blocking a fault current including a load current and a switch for opening or closing a load current have been widely used.

This circuit breaker is categorized into a hydraulic circuit breaker, an air circuit breaker, a gas circuit breaker, and a vacuum circuit breaker in accordance with an insulating medium of a core portion.

Among the circuit breakers, the vacuum circuit breaker has a small size, high reliability, excellent multi-frequency switching characteristic and easiness in maintenance, whereby a vacuum circuit breaker having high voltage high capacity as well as a vacuum circuit breaking having medium voltage low capacity has been widely used.

Meanwhile, the vacuum interrupter is used as a breaker of the vacuum circuit breaker, and is installed inside a housing assembly body and senses a current or voltage generated on a high-tension line of a high-tension circuit through a converter. And, if a switching driver performs straight line reciprocating motion for an operator to change a switching state of the high-tension circuit, an actuating electrode portion of the vacuum interrupter, which is installed at one side of the operator, is in contact with and detached from a fixed electrode portion to supply and block a power.

Meanwhile, FIG. 1 is a cross-sectional view illustrating a vacuum interrupter 10 provided in a vacuum circuit breaker of the related art.

As shown in FIG. 1, the vacuum interrupter 10 of the related art includes an insulating envelope 13 made of four ceramics and sealed with a fixed flange 11 and an actuating flange 12, a fixed electrode portion 14 having a fixed electrode 14*a* at one end, an actuating electrode portion 15 provided with an actuating electrode 15*a* which is in contact with or detached from the fixed electrode portion 14, a center shield 16 and an auxiliary shield 17, wherein the fixed electrode portion 14 and the actuating electrode portion 15 are arranged inside the insulating envelope 13 to mutually face each other.

At this time, the center shield 16 is arranged at the center between the actuating electrode 15*a* and the fixed electrode 14*a* inside the insulating envelope 13, and the auxiliary shield 17 is provided at each of upper and lower sides of the center shield 16 inside the insulating envelope 13.

However, the vacuum interrupter 10 for the vacuum circuit breaker according to the related art, which is configured as above, has problems as follows. That is, since the center shield 16 and the auxiliary shield 17 are arranged inside the insulating envelope 13, an inner diameter of the insulating envelope 13 should be greater than an outer diameter of each shield 16, 17, whereby a problem occurs in that the insulating envelope 13 in which each shield 16, 17 is received should be manufactured at a great size.

Also, since the size of the vacuum interrupter 10 is increased, the amount of use of ceramic is increased, whereby a problem occurs in that the manufacturing cost of the vacuum interrupter is greatly increased.

SUMMARY OF THE INVENTION

Therefore, an object of the present invention is to solve the aforementioned problems. Another object of the present invention is to provide a vacuum interrupter for a vacuum circuit breaker, in which a center shield provided in the vacuum interrupter is arranged on the same line as an insulating envelope to reduce a size of the insulating envelope and save the manufacturing cost.

To achieve these and other objects and in accordance with the purpose of the present invention, as embodied and broadly described herein, a vacuum interrupter for a vacuum circuit breaker comprises an upper insulating envelope; a lower insulating envelope arranged below the upper insulating envelope; a fixed electrode portion installed to be fixed to the inside of the upper insulating envelope; an actuating electrode portion installed inside the lower insulating envelope to face the fixed electrode portion and to be in contact with or detached from the fixed electrode portion; and a center shield arranged between the upper insulating envelope and the lower insulating envelope, receiving the fixed electrode portion and the actuating electrode portion.

Also, the vacuum interrupter for a vacuum circuit breaker further comprises a first auxiliary shield provided inside the upper insulating envelope and the lower insulating envelope.

Also, the center shield has an outer diameter the same as or greater than an inner diameter of each of the upper insulating envelope and the lower insulating envelope.

Also, a fixed electrode is formed at one end of the fixed electrode portion, an actuating electrode, which is in contact with or detached from the fixed electrode, is formed at one end of the actuating electrode portion, and the center shield has an inner diameter greater than a sum of an outer diameter of the fixed electrode or the actuating electrode and a distance between the respective electrodes.

Also, the first auxiliary shield is provided with a fixed portion, the upper insulating envelope includes a first upper envelope and a second upper envelope arranged below the first upper envelope to allow the fixed portion to be fitted between the first upper envelope and the second upper envelope, and the lower insulating envelope includes a first lower envelope and a second lower envelope arranged below the first lower envelope to allow the fixed portion to be fitted between the first lower envelope and the second lower envelope.

Also, upper and lower lengths of the first upper envelope and the second lower envelope are the same as those of the second upper envelope and the first lower envelope.

Also, a second auxiliary shield is formed respectively between the upper insulating envelope and the center shield and between the lower insulating envelope and the center shield.

Also, the second auxiliary shield is provided with a protrusion which is formed to be outwardly protruded.

Also, the protrusion is formed in a single body with the second auxiliary shield or connected with the second auxiliary shield through welding.

Also, the protrusion has one end formed to be inwardly bent in a circular shape or curved shape.

Also, a flange is provided above the upper insulating envelope and below the lower insulating envelope to seal the insides of the upper insulating envelope and the lower insulating envelope.

As described above, the vacuum interrupter for a vacuum circuit breaker according to the present invention allows the center shield to be arranged between the upper insulating envelope and the lower insulating envelope, whereby upper and lower lengths of the respective insulating envelopes are reduced.

Also, the center shield is arranged between the upper insulating envelope and the lower insulating envelope, whereby the center shield is not provided inside each of the insulating envelopes and thus outer diameters of the respective insulating envelopes are reduced.

Also, as the upper and lower lengths and the outer diameters of the insulating envelopes are reduced, a full size of the insulating envelopes is reduced, whereby the amount of ceramic used to manufacture the insulating envelopes is reduced and thus the manufacturing cost is saved remarkably.

Also, as the second auxiliary shield is provided with the protrusion and one end of the protrusion is formed in a bent circular shape or curved shape, concentration of electric field is prevented from occurring at the junction area of the center shield, the upper insulating envelope and the lower insulating envelope, that is, the junction area through brazing welding, whereby partial discharge or breakdown of insulation is prevented from occurring at the junction area.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a vacuum interrupter provided in a vacuum circuit breaker according to one embodiment of the present invention will be described in detail with reference to the accompanying drawings.

Figure 1:
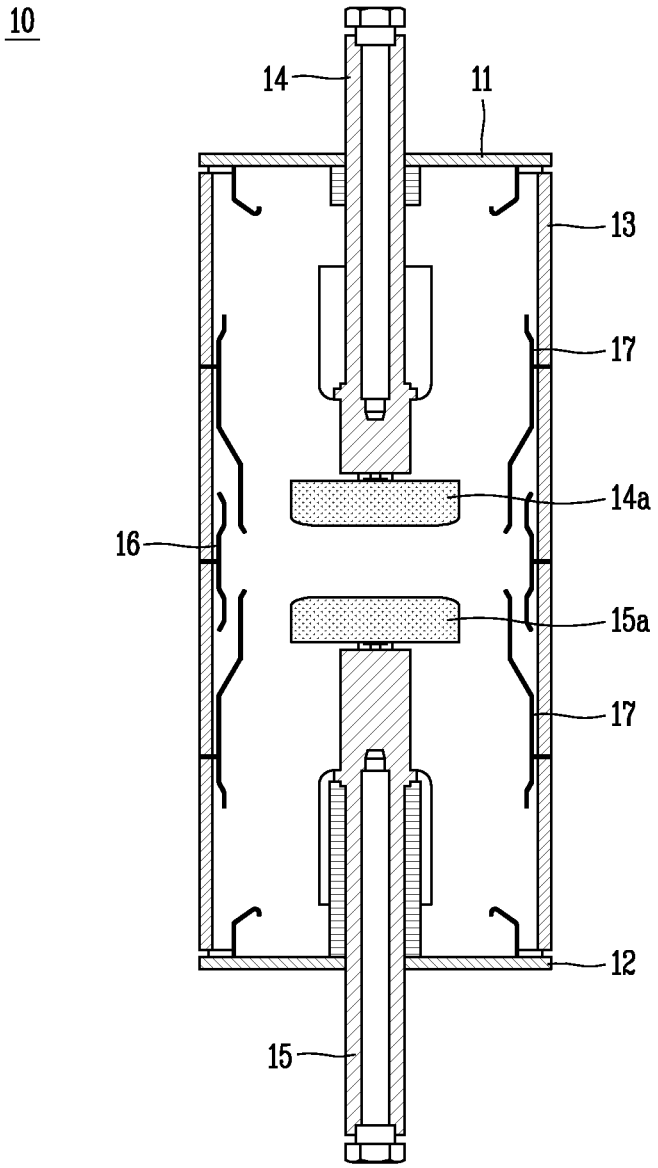
FIG. 1 RELATED ART
FIG. 1 is a cross-sectional view illustrating a vacuum interrupter provided in a vacuum circuit breaker of the related art.
Figure 2:
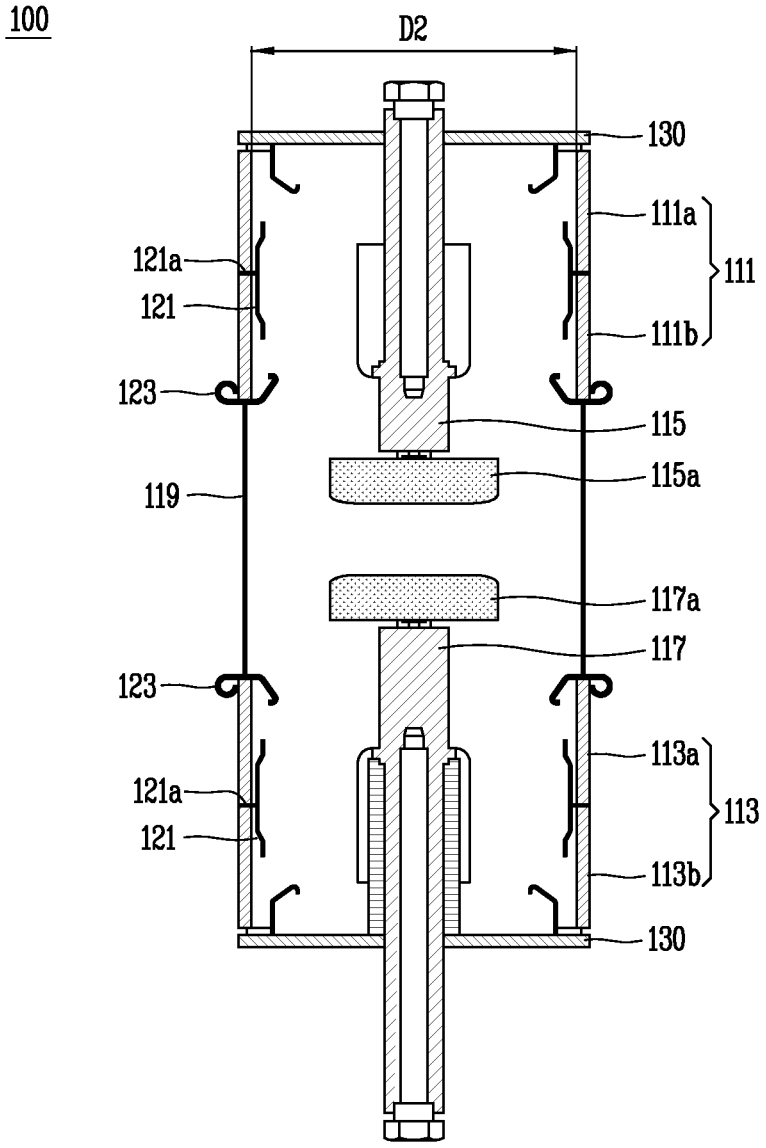
FIG. 2 is a cross-sectional view illustrating a vacuum interrupter provided in a vacuum circuit breaker according to one embodiment of the present invention.
Figure 3:
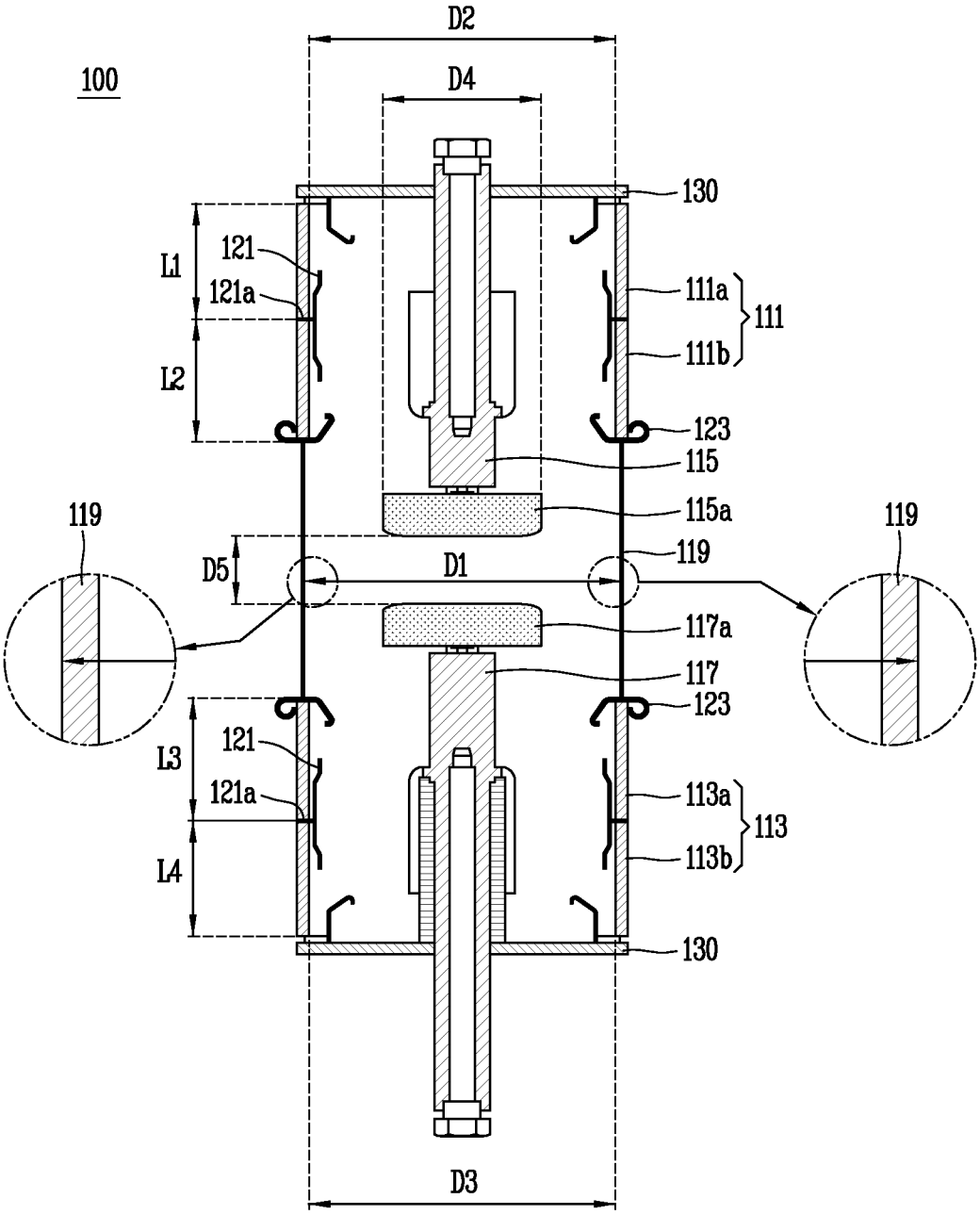
FIG. 3 is a cross-sectional view illustrating a vacuum interrupter provided in a vacuum circuit breaker according to another embodiment of the present invention.
Figure 4:
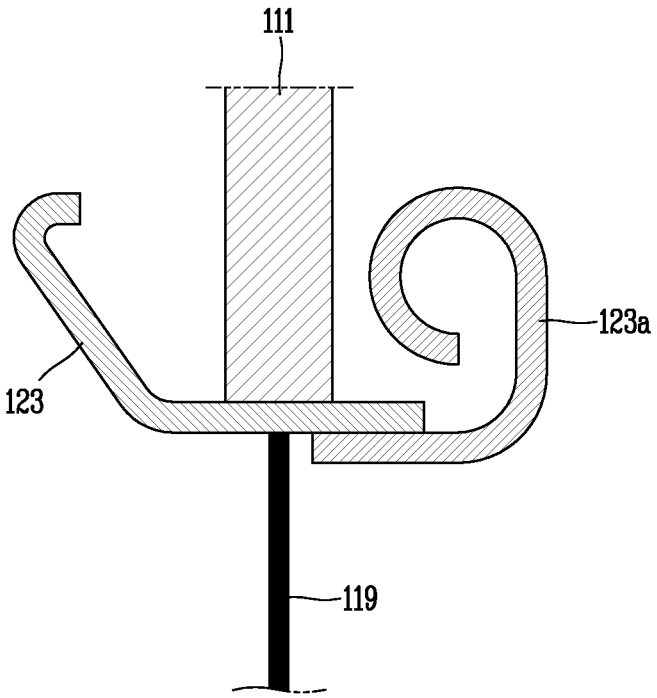
FIG. 4 is a partially enlarged view illustrating a second auxiliary shield of a vacuum interrupter provided in a vacuum circuit breaker according to the present invention.

FIG. 2 is a cross-sectional view illustrating a vacuum interrupter provided in a vacuum circuit breaker according to the present invention, FIG. 3 is a cross-sectional view illustrating a vacuum interrupter provided in a vacuum circuit breaker according to another embodiment of the present invention, and FIG. 4 is a partially enlarged view illustrating a second auxiliary shield of a vacuum interrupter provided in a vacuum circuit breaker according to the present invention.

As shown in FIGS. 2 and 3, a vacuum interrupter 100 for a vacuum circuit breaker according to the present invention includes an upper insulating envelope 111, a lower insulating envelope 113, a fixed electrode portion 115, an actuating electrode portion 117, a center shield 119, and a first auxiliary shield 121.

The upper insulating envelope 111 is made of ceramic or reinforced glass, and constitutes upper side enclosure such that the fixed electrode portion 115 is arranged inside the upper insulating envelope 111.

The lower insulating envelope 113 is made of ceramic or reinforced glass, and constitutes lower side enclosure such that the actuating electrode portion 117 is arranged inside the lower insulating envelope 113.

The fixed electrode portion 115 is provided inside the upper insulating envelope 111, and includes a fixed electrode 115*a* at one end thereof and thus is in contact with or detached from the actuating electrode portion 117 in accordance with movement of the actuating electrode portion 117.

The actuating electrode portion 117 is installed inside the lower insulating envelope 113 to face the fixed electrode portion 115, and includes an actuating electrode 117*a* at one end thereof and thus is in contact with or detached from the fixed electrode portion 115 in accordance with up and down movement.

The center shield 119 is used so that metal steam generated during current breaking is not deposited on an inner wall of each insulating envelope 111, 113, and is made of stainless steel or Cu and arranged between the upper insulating envelope 111 and the lower insulating envelope 113.

Also, the center shield 119 is connected to each of one end and the other end of the upper insulating envelope 111 and the lower insulating envelope 113 through welding such as blazing, and constitutes enclosure of a center to receive the fixed electrode portion 115 and the actuating electrode portion 117 therein.

At this time, the center shield 119 is not provided inside each insulating envelope 111, 113 but arranged between the upper insulating envelope 111 and the lower insulating envelope 113, whereby an inner diameter of each insulating envelope 111, 113 becomes smaller.

Meanwhile, an outer diameter D1 of the center shield 119 is formed to be the same as or greater than inner diameters D2 and D2 of the upper insulating envelope 111 and the lower insulating envelope 113.

Also, since the center shield 119 has a thickness thinner than that of each of the upper insulating envelope 111 and the lower insulating envelope 113, the diameter D1 of the center shield 119 is formed to be smaller than an outer diameter (not shown) of each of the upper insulating envelope 111 and the lower insulating envelope 113. However, without limitation to the above example, the outer diameter D1 of the center shield 119 may be formed to be greater than the outer diameter of each of the upper insulating envelope 111 and the lower insulating envelope 113.

Also, an inner diameter of the center shield 119 is formed to be greater than a sum of an outer diameter D4 of the fixed electrode 115*a* or the actuating electrode 117*a* and a distance D5 between the respective electrodes, whereby the center shield 119 is sufficiently spaced apart from each of the electrodes 115*a* and 117*a*. As a result, the current is prevented from entering the actuating electrode 117*a* through the center shield 119 from the fixed electrode 115*a* and thus breakdown of insulation is prevented from occurring in the vacuum interrupter 100.

The first auxiliary shield 121 is provided respectively inside each of the upper insulating envelope 111 and the lower insulating envelope 113.

Meanwhile, the first auxiliary shield 121 is provided with a fixed portion 121*a* formed to be fitted between a first upper envelope 111*a* and a second upper envelope 111*b* or between a first lower envelope 113*a* and a second lower envelope 113*b*, which will be described later.

Also, the upper insulating envelope 111 includes the first upper envelope 111*a*, and the second upper envelope 111*b* arranged below the first upper envelope 111*a*. As the fixed portion 121*a* is fitted between the first upper envelope 111*a* and the second upper envelope 111*b*, the first auxiliary shield 121 is arranged to be tightly adhered to the upper insulating envelope 111.

In addition, the lower insulating envelope 113 includes the first lower envelope 113*a*, and the second lower envelope 113*b* arranged below the first lower envelope 113*a*. As the fixed portion 121*a* is fitted between the first lower envelope 113*a* and the second lower envelope 113*b*, the first auxiliary shield 121 is arranged inside the lower insulating envelope 113.

At this time, upper and lower lengths L1 and L4 of the first upper envelope 111*a* and the second lower envelope 113*b* are formed to be the same as each other, and upper and lower lengths L2 and L3 of the second upper envelope 111*b* and the first lower envelope 113*a* are also formed to be the same as each other.

Therefore, symmetricity of the respective envelopes constituting enclosure of the vacuum interrupter 100 is improved, whereby insulating performance of the vacuum interrupter 100 is maintained.

That is, since a voltage for applying a current may be applied to an upper side where the first upper envelope 111*a* and the second upper envelope 111*b* are arranged or a lower side where the first lower envelope 113*a* and the second lower envelope 113*b* are arranged, the respective upper envelopes 111*a* and 111*b* and the respective lower envelopes 113*a* and 113*b* corresponding to the respective upper envelopes 111*a* and 111*b* are formed to have the same size having insulating performance suitable for the applied voltage, whereby insulating performance is maintained uniformly regardless of the fact that the voltage is applied to the upper side or the lower side.

Meanwhile, a second auxiliary shield 123 is formed respectively between the upper insulating envelope 111 and the center shield 119 and between the lower insulating envelope 113 and the center shield 119.

As shown in FIG. 4, the second auxiliary shield 123 is provided with a protrusion 123*a* formed to be protruded toward the outside, wherein one end of the protrusion 123*a* is bent inwardly in a circular shape or curved shape.?

At this time, the protrusion 123*a* may be formed in a single body with the second auxiliary shield 123, or may be manufactured separately to be mutually connected with the second auxiliary shield 123 through welding.

Therefore, since one end of the protrusion 123*a* is bent and formed in a circular shape or curved shape, concentration of electric field is prevented from occurring at a junction area of the center shield 119, the upper insulating envelope 111 and the lower insulating envelope 113, that is, a junction area through brazing welding, whereby partial discharge or breakdown of insulation is prevented from occurring at the junction area.

In addition, a flange 130 is provided above the upper insulating envelope 111 and below the lower insulating envelope 113, whereby the upper end of the upper insulating envelope 111 and the lower end of the lower insulating envelope 113 are blocked by the flange 130 and thus their insides are sealed.

The vacuum interrupter 100 for a vacuum circuit breaker according to the present invention, which is configured and operated as above, allows the center shield 119 to be arranged between the upper insulating envelope 111 and the lower insulating envelope 113, whereby upper and lower lengths of the respective insulating envelopes 111 and 113 are reduced.

Also, the center shield 119 is arranged between the upper insulating envelope 111 and the lower insulating envelope 113, whereby the center shield 119 is not provided inside each of the insulating envelopes 111 and 113 and thus outer diameters of the respective insulating envelopes 111 and 113 are reduced.

Also, as the upper and lower lengths and the outer diameters of the insulating envelopes 111 and 113 are reduced, a full size of the insulating envelopes 111 and 113 is reduced, whereby the amount of ceramic used to manufacture the insulating envelopes 111 and 113 is reduced and thus the manufacturing cost is saved remarkably.

Also, as the second auxiliary shield 123 is provided with the protrusion 123*a* and one end of the protrusion 123*a* is bent to be formed in a circular shape or curved shape, concentration of electric field is prevented from occurring at the junction area of the center shield 119, the upper insulating envelope 111 and the lower insulating envelope 113, that is, the junction area through brazing welding, whereby partial discharge or breakdown of insulation is prevented from occurring at the junction area.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum interrupter for a vacuum circuit breaker, comprising:

an upper insulating envelope;

a lower insulating envelope arranged below the upper insulating envelope;

a fixed electrode portion installed to be fixed to inside of the upper insulating envelope;

an actuating electrode portion installed inside the lower insulating envelope to face the fixed electrode portion and to be in contact with or detached from the fixed electrode portion;

a center shield arranged between the upper insulating envelope and the lower insulating envelope, receiving the fixed electrode portion and the actuating electrode portion; and a first auxiliary shield provided inside the upper insulating envelope and the lower insulating envelope, wherein a second auxiliary shield is formed respectively between the upper insulating envelope and the center shield and between the lower insulating envelope and the center shield, wherein the second auxiliary shield is provided with a protrusion which is formed to be outwardly protruded, and wherein the protrusion has one end formed to be inwardly bent in a circular shape or curved shape.

2. The vacuum interrupter for the vacuum circuit breaker according to claim 1, wherein the center shield has an outer diameter the same as or greater than an inner diameter of each of the upper insulating envelope and the lower insulating envelope.

3. The vacuum interrupter for the vacuum circuit breaker according to claim 1, wherein a fixed electrode is formed at one end of the fixed electrode portion, an actuating electrode, which is in contact with or detached from the fixed electrode, is formed at one end of the actuating electrode portion, and the center shield has an inner diameter greater than a sum of an outer diameter of the fixed electrode or the actuating electrode and a distance between the respective electrodes.

4. The vacuum interrupter for the vacuum circuit breaker according to claim 1, wherein the first auxiliary shield is provided with a fixed portion, the upper insulating envelope includes a first upper envelope and a second upper envelope arranged below the first upper envelope to allow the fixed portion to be fitted between the first upper envelope and the second upper envelope, and the lower insulating envelope includes a first lower envelope and a second lower envelope arranged below the first lower envelope to allow the fixed portion to be fitted between the first lower envelope and the second lower envelope.

5. The vacuum interrupter for the vacuum circuit breaker according to claim 4, wherein upper and lower lengths of the first upper envelope and the second lower envelope are the same as those of the second upper envelope and the first lower envelope.

6. The vacuum interrupter for the vacuum circuit breaker according to claim 1, wherein the protrusion is formed in a single body with the second auxiliary shield or connected with the second auxiliary shield through welding.

7. The vacuum interrupter for the vacuum circuit breaker according to claim 1, wherein a flange is provided above the upper insulating envelope and below the lower insulating envelope to seal the insides of the upper insulating envelope and the lower insulating envelope.

* * * * *